US009617780B2

(12) United States Patent
Heikkila et al.

(10) Patent No.: US 9,617,780 B2
(45) Date of Patent: Apr. 11, 2017

(54) TRIPLE PANE WINDOW SPACER, WINDOW ASSEMBLY AND METHODS FOR MANUFACTURING SAME

(71) Applicant: GUARDIAN IG, LLC, Sun Prairie, WI (US)

(72) Inventors: Kurt E. Heikkila, Marine on the St. Croix, MN (US); Eric B. Rapp, Avoca, WI (US)

(73) Assignee: Guardian IG, LLC, Sun Prairie, WI (US)

( * ) Notice: Subject to any disclaimer, the term of this patent is extended or adjusted under 35 U.S.C. 154(b) by 0 days.

(21) Appl. No.: 14/986,907

(22) Filed: Jan. 4, 2016

(65) Prior Publication Data

US 2016/0194914 A1 Jul. 7, 2016

Related U.S. Application Data

(63) Continuation of application No. 13/326,501, filed on Dec. 15, 2011, now Pat. No. 9,228,389.

(60) Provisional application No. 61/424,545, filed on Dec. 17, 2010.

(51) Int. Cl.

| | |
|---|---|
| ***E06B 3/66*** | (2006.01) |
| ***E06B 3/263*** | (2006.01) |
| ***E06B 3/54*** | (2006.01) |
| ***E06B 3/673*** | (2006.01) |
| ***E06B 3/64*** | (2006.01) |
| ***E06B 7/12*** | (2006.01) |

(Continued)

(52) U.S. Cl.

CPC ..... *E06B 3/6608* (2013.01); *E06B 3/26305* (2013.01); *E06B 3/5454* (2013.01); *E06B 3/64* (2013.01); *E06B 3/6612* (2013.01); *E06B 3/66366* (2013.01); *E06B 3/67326* (2013.01); *E06B 7/12* (2013.01); *E06B 3/273* (2013.01); *E06B 3/67308* (2013.01); *E06B 3/67317* (2013.01); *E06B 2003/2635* (2013.01); *E06B 2003/26376* (2013.01); *Y10T 29/49826* (2015.01)

(58) Field of Classification Search

CPC .... E06B 3/26305; E06B 3/273; E06B 3/5454; E06B 3/64; E06B 3/6608; E06B 3/6612; E06B 3/67326; E06B 2003/2635; E06B 2003/26376; E06B 7/12

USPC ..... 52/172, 204.593, 204.595; 428/131

See application file for complete search history.

(56) References Cited

U.S. PATENT DOCUMENTS 3,401,496 A * 9/1968 Zopnek ..... E04C 2/54 52/204.593

3,425,163 A * 2/1969 Horgan, Jr. ..... E05D 15/0665 49/413

(Continued)

FOREIGN PATENT DOCUMENTS

CH EP 0117885 A1 * 9/1984 ..... E06B 3/64

*Primary Examiner* — Patrick Maestri
*Assistant Examiner* — Joseph J Sadlon
(74) *Attorney, Agent, or Firm* — Remarck Law Group PLC

(57) ABSTRACT

A spacer, window assembly, method of manufacturing a window assembly, and method of manufacturing a spacer is described herein involving window assemblies having three sheets of material, which will be referred to as a triple pane assembly. Two interior spaces are defined within the window assembly: a first air space between the first sheet and intermediary sheet and a second air space between the second sheet and the intermediary sheet.

20 Claims, 12 Drawing Sheets

(51) Int. Cl.
*E06B 3/663* (2006.01)
*E06B 3/273* (2006.01)

(56) References Cited

U.S. PATENT DOCUMENTS 4,259,135 A * 3/1981 Kulla ..... E04F 21/28
156/145
4,608,796 A * 9/1986 Shea, Jr. ..... E06B 1/36
52/204.595
5,514,428 A * 5/1996 Kunert ..... B32B 5/24
156/109
5,622,019 A * 4/1997 Dorough, Jr. ..... C03B 13/08
52/308
6,463,706 B1 * 10/2002 Guhl ..... C03C 27/06
428/34
6,868,648 B2 * 3/2005 Glover ..... E06B 3/24
52/786.1

* cited by examiner

TRIPLE PANE WINDOW SPACER, WINDOW ASSEMBLY AND METHODS FOR MANUFACTURING SAME

CROSS-REFERENCE TO RELATED APPLICATIONS

This application is a continuation of U.S. application Ser. No. 13/326,501, filed Dec. 15, 2011, which claims the benefit of U.S. Provisional Application No. 61/424,545, filed Dec. 17, 2010, the contents of both applications are incorporated herein by reference.

This application is related to the following U. S. patent applications: "SEALED UNIT AND SPACER", U.S. 2009/0120035, filed Nov. 13, 2008; "REINFORCED WINDOW SPACER", U.S. 2009/0120019, filed Nov. 13, 2008; "BOX SPACER WITH SIDEWALLS", U.S. 2009/0120036, filed Nov. 13, 2008; "REINFORCED WINDOW SPACER", U.S. 2009/0120019, filed Nov. 13, 2008; "SEALED UNIT AND SPACER WITH STABILIZED ELONGATE STRIP", U.S. 2009/0120018, filed Nov. 13, 2008; "MATERIAL WITH UNDULATING SHAPE" U.S. 2009/0123694, filed Nov. 13, 2008; and "STRETCHED STRIPS FOR SPACER AND SEALED UNIT", U.S. 2011/0104512, filed Jul. 14, 2010; U.S. patent application Ser. No. 13/157,866, "WINDOW SPACER APPLICATOR", filed Jun. 10, 2011; and U.S. Provisional Patent Application Ser. No. 61/386,732, "WINDOW SPACER, WINDOW ASSEMBLY AND METHODS FOR MANUFACTURING SAME", filed Sep. 27, 2010; which are all hereby incorporated by reference in their entirety.

BACKGROUND

Windows often include two or more facing sheets of glass separated by an air space. The air space reduces heat transfer through the window to insulate the interior of a building to which it is attached from external temperature variations. As a result, the energy efficiency of the building is improved, and a more even temperature distribution is achieved within the building.

SUMMARY

Figure 1:
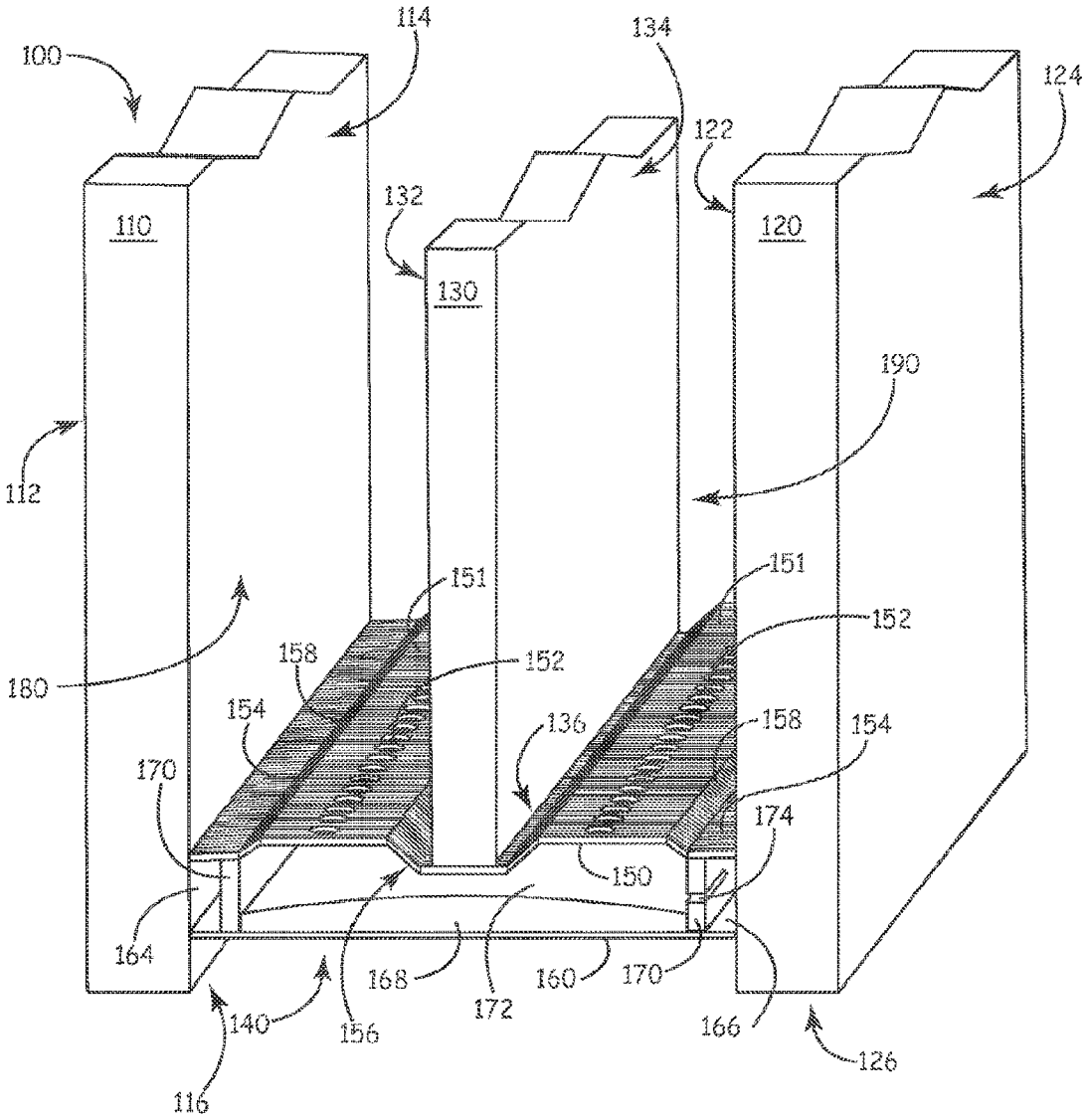
FIG. 1 depicts a partial perspective view of one implementation of a window assembly described herein.

A spacer, window assembly, method of manufacturing a window assembly, and method of manufacturing a spacer is described herein. In particular, this application is focused on window assemblies having three sheets of material, such as panes of glass, which are separated by two air spaces, which will be referred to as a triple pane assembly. By providing three sheets of material and two air spaces, instead of two sheets and one air space, for example, the insulation value of the window assembly is significantly increased.

One embodiment of a window assembly includes a first sheet of material, a second sheet of material, and an intermediary sheet of material between the first and second sheets. The window assembly also includes a spacer arranged between the first and second sheets, and in contact with the intermediary sheet, in order to keep the sheets spaced from each other. The spacer forms a closed loop near to the perimeter of the sheets, and is able to withstand compressive forces to maintain the desired space. Two interior spaces are defined within the window assembly: a first air space between the first sheet and intermediary sheet and a second air space between the second sheet and the intermediary sheet.

When the window assembly is positioned in a structure, one of the sheets of material will typically be on an exterior side of a building and that exterior sheet will be referred to as the first sheet, while the second sheet is positioned on the interior side of the building and window assembly. Each sheet has an interior face and an exterior face, where the interior face is the face that is intended to be closest to the interior of the building and the exterior face is the face that is intended to be closest to the exterior. However, it is possible that window assemblies also be used within the interior of buildings and in other contexts. In some embodiments, the window assembly can be positioned with either side near a building's exterior, but in many embodiments the configuration is designed to be positioned with one side near the building's exterior to minimize heat transfer, maximize the thermal comfort of the occupants, and provide other performance characteristics.

In one embodiment, a window spacer includes a first elongate strip having a first surface and having an undulating shape, the first elongate strip including a plurality of openings extending through the first elongate strip, and a second elongate strip having a second surface, wherein the second surface is spaced from the first surface. The window spacer further includes at least one filler arranged between the first and second surfaces, the filler including a desiccant; wherein the first elongate strip defines a registration structure configured to receive an intermediary sheet of a material.

In another embodiment, a method of making a window assembly includes providing first, second and intermediary sheets of material and providing a spacer. The spacer includes a first elongate strip having a first surface and having an undulating shape. The first elongate strip includes a plurality of apertures extending through the first elongate strip and defining a registration structure for contacting the intermediary sheet of material. The spacer further includes a second elongate strip having a second surface and having an undulating shape, wherein the second surface is spaced from the first surface. The method also includes applying a sealant or adhesive material to the registration structure and to first and second sides of the spacer and fastening the intermediary sheet to the spacer contacting the registration structure. The method further includes sealing the spacer between the first and second sheets so that the intermediary sheet is positioned between the first and second sheets.

Another embodiment is a window assembly including a first sheet of material, a second sheet of material and an intermediary sheet of material between the first sheet and the second sheet. A first space is defined between the first sheet and the intermediary sheet and a second space is defined between the second sheet and the intermediary sheet. The assembly includes a spacer arranged between the first sheet and the second sheet. The spacer includes a first elongate strip having a first surface and having an undulating shape, the first elongate strip including a plurality of apertures extending through the first elongate strip. The spacer also includes a second elongate strip having a second surface and having an undulating shape; wherein the second surface is spaced from the first surface. The spacer further includes at least one filler arranged between the first and second surfaces, the filler including a desiccant. The first elongate strip defines a registration structure for contacting the intermediary sheet. The window assembly further includes a sealant material or adhesive material located between the spacer and the first sheet and between the spacer and the second sheet.

Now the technology will be described with respect to the Figures.

DETAILED DESCRIPTION OF PARTICULAR EMBODIMENTS

Figure 2:
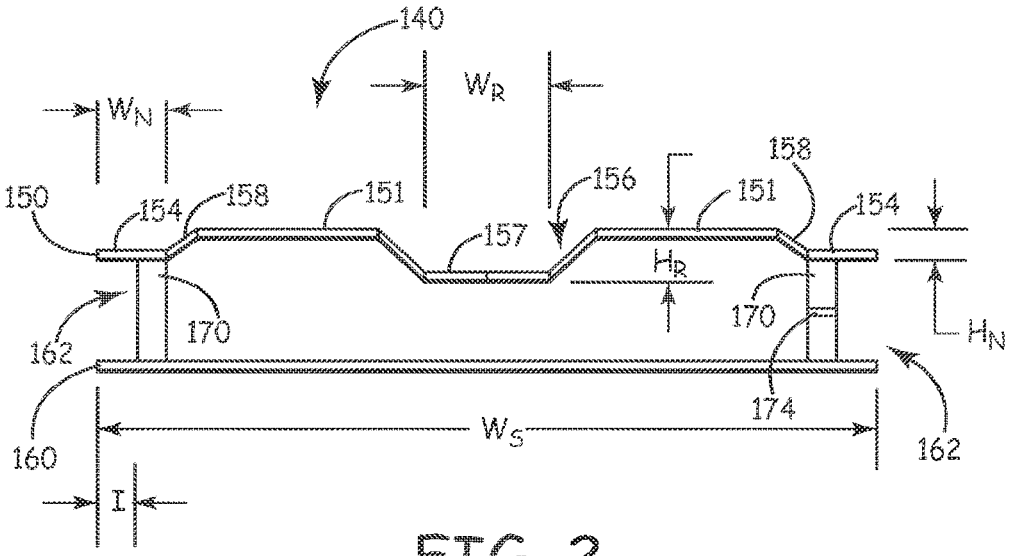
FIG. 2 depicts a cross-sectional view of a spacer component of FIG. 1, consistent with the technology disclosed herein.

FIG. 1 depicts a partial perspective view of one implementation of a spacer incorporated in a window assembly, consistent with the technology disclosed herein. FIG. 2 depicts a cross-sectional view of the spacer shown in FIG. 1. This particular implementation is consistent with what will be referred to as a symmetrical triple pane window assembly.

Window assembly 100 includes a first sheet 110, a second sheet 120, an intermediary sheet 130 and a spacer 140 disposed between the first sheet 110 and the second sheet 120. The first sheet 110 defines a first sheet surface 112, a second sheet surface 114, and a perimeter 116. The intermediary sheet defines a third sheet surface 132, a fourth sheet surface 134, and a perimeter 136. The second sheet 120 defines a fifth sheet surface 122, a sixth sheet surface 124, and a perimeter 126. FIG. 1 is a partial view of the window assembly 100 and depicts the spacer 140 disposed adjacent to the bottom perimeter 116 of the first sheet and the bottom perimeter 126 of the second sheet 110. It should be understood that the spacer 140 is disposed between the first sheet 110 and the second sheet 120 adjacent to the entire perimeters of the sheets 110, 120.

In one implementation of this particular window assembly 100, the first sheet 110 is the exterior side of the window assembly 100 and the second sheet 120 is on the interior side of the window assembly 100. Various coating can be applied to the various surfaces of the first sheet 110, second sheet 120, and intermediary sheet 130 to offer heat transfer advantages. In some embodiments, low emissivity coatings are positioned on the first sheet 110. For example, a low emissivity coating is positioned on the second surface 114 of the first sheet 110 in one embodiment. In some embodiments, a low emissivity coating is positioned on the intermediary sheet, such as on the third surface 132. Such coatings can increase the amount of radiant energy that is reflected by a material rather than absorbed and emitted by the material. As a result, such coatings reduce the ability of the material to transfer heat, and result in a window assembly having a lower U-factor. U-factor is the term used to quantify heat transfer.

In one embodiment, an infrared-transmitting, low-emissivity coating is on the second surface 114, which is the interior face of the most exterior sheet, while an infrared-reflecting, low-emissivity coating is present on the third surface 132, which is the exterior face of the intermediary sheet 130. An infrared reflecting coating can reduce solar energy transmission through the window assembly and can be desirable during relatively warmer seasons where indoor spaces are cooled.

One example of an infrared-transmitting, low-emissivity coating is LoE-178 coating available from Cardinal Glass of Eden Prairie, Minn. One example of an infrared-reflecting, low-emissivity coating is $LoE^2$ coating, also available from Cardinal Glass.

First sheet 110, second sheet 120 and intermediary sheet 130 are generally made of a material that allows at least some light to pass through. Typically, first sheet 110, second sheet 120 and intermediary sheet 130 are made of a substantially planar, transparent material, such as glass, plastic, or other suitable materials. Alternatively, a translucent or semi-transparent material is used, such as etched, stained, or tinted glass or plastic. It is also possible for first sheet 110, second sheet 120 and intermediary sheet 130 to be opaque, such as decorative opaque sheets. In some embodiments the first sheet 110, second sheet 120 and intermediary sheet 130 are all the same type material. In other embodiments, the first sheet 110, second sheet 120 and intermediary sheet 130 are different types of materials. In other embodiments, the first sheet 110 and the second sheet 120 are the same material, while the intermediary sheet 130 is a different material. In one embodiment, the intermediary sheet includes plastic and the first and second sheets include glass. In one particular embodiment, the intermediary sheet 130 has a smaller thickness that the first sheet 110 and the second sheet 120, although other configurations are possible. In a variety of embodiment, there can be multiple intermediary sheets. In at least one embodiment, there are two intermediary sheets.

When the window assembly 100 is fully assembled, a gas is sealed within a first air space 180, defined between the first sheet 110 and the intermediary sheet 130, and a second air space 190, defined between the second sheet 120 and the intermediary sheet 130. In embodiments where there are multiple intermediary sheets, additional air spaces will be defined. In some embodiments, the gas is air. In some embodiments, the gas includes oxygen, carbon dioxide, nitrogen, or other gases. Yet other embodiments include an inert gas, such as helium, neon or a noble gas such as krypton, argon, xenon and the like. Combinations of these or other gases are used in other embodiments. In the current embodiment, the intermediary sheet 130 is positioned to be approximately equidistant from the first sheet 110 and the second sheet 120, so the width of the first air space 180 is approximately equal to the size of the second air space 190, and other embodiments will be described.

Many different options are available for the particular width of the first air space and the second air space, as set forth in the chart below. In some embodiments, the width is about ⅛ inch (3.2 mm) or more, about ¼ inch (6.3 mm) or more, and about ⅜ inch (9.5 mm) or more. In some embodiments, the width is about ½ inches (12.7 mm) or less, about 1½ inch (3.8 cm) or less, about 1¼ inch (3.2 cm) or less and about 1 inch (2.5 cm) or less. In some embodiments, the width is about ¼ inch (6.3 mm), about ⅜ inch (9.5 mm), about ½ inch (12.7 mm) and about ⅝ inch (15.9 mm). In some embodiments, the width ranges from ¼ inch to ½ inch (6.3 mm to 12.7 mm).

Figure 3:
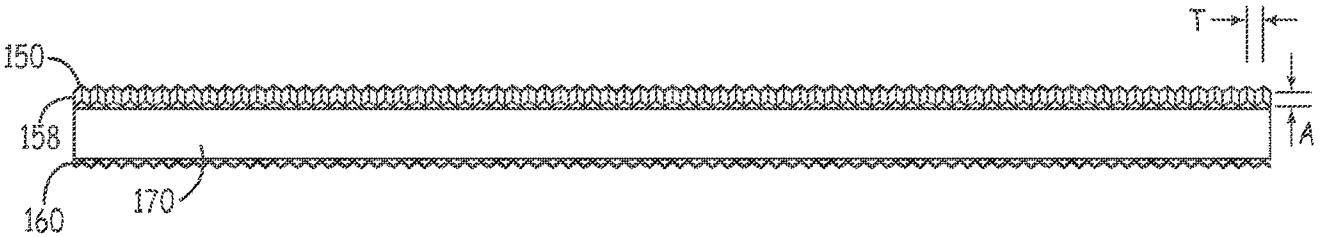
FIG. 3 depicts a side view of the component of FIGS. 1 and 2, consistent with the technology disclosed herein.

The spacer 140 includes a first elongate strip 150, a second elongate strip 160, and support legs 170 that mutually define an interior cavity 172 that may contain a filler 158. The spacer 140 is disposed between the first sheet 110 and the second sheet 120 to keep the sheets 110, 120 spaced from each other. The spacer 140 defines a registration structure 156 that is configured to at least partially contact the perimeter 136 of the intermediary sheet 130 between the first sheet 110 and the second sheet 120. In some embodiments, the registration structure is configured to receive the perimeter of the intermediary sheet 130. In the embodiment of FIGS. 1-3, the registration structure 156 is a channel or depressed portion in the first elongate strip, as will be further described herein. The registration structure has a different configuration in other embodiments, such as a protrusion from the first elongate strip or a ledge. In some embodiments, such as the embodiment of FIGS. 1-3, the registration structure is integral with and formed by the first elongate strip. In some embodiments, the registration structure is elongate and continuous along the first elongate strip, as illustrated in FIGS. 1-3. In other embodiments, the registration structure is not continuous and is present intermittently along the first elongate strip. In embodiments of the current technology incorporating multiple intermediary sheets, multiple registration structures will be defined.

Typically, the spacer 140 is arranged to form a closed loop adjacent to the perimeters 116, 126 of at least the first sheet 110 and second sheet 120, but in a variety of embodiments also adjacent to the perimeter 136 of the intermediary sheet 130. Spacer 140 is generally structured to withstand compressive forces applied to the first sheet 110 and/or the second sheet 120 to maintain a desired space between the sheets 110, 120, 130. A first air space 180 is defined within window assembly 100 by the spacer 140, the first sheet 110 and the intermediary sheet 130. A second air space 190 is defined within the window assembly 100 by the spacer 140, the second sheet 120, and the intermediary sheet 120.

The support legs 170 are also elongate and provide a uniform or substantially uniform spacing between elongate strips 150, 160, maintaining the strips in a parallel or substantially parallel orientation. The support legs 170 are substantially parallel to each other. The support legs 170 are substantially continuous in multiple embodiments and are arranged at intermediate positions between parallel elongate edges of the elongate strips 150, 160. In a variety of embodiments, the support legs 170 are constructed of nylon, although those having skill in the art will appreciate other materials that would also be suitable.

In one embodiment, the support legs are constructed of a material having mechanical properties so that the support legs can withstand compressive forces and assist with maintaining the desired rigidity of the spacer. The support legs maintain the substantially parallel orientation of the elongate strips during the window assembly process and to some degree in the finished window assembly. The first and second support legs extend between the first and second elongate strips and are arranged to define an interior space or interior cavity 172. In some embodiments, a slit 174 is defined by at least one of the support legs 170 in order to facilitate depositing a filler 158 into the interior cavity 172 or interior space of the spacer 140. In FIG. 1, although the slit 174 is defined in the right support leg 170, it can also be located in the left support leg 170. In one embodiment, the slit 174 extends the length of the spacer 140. In the illustrated embodiment, the slit 174 is in an approximate central portion of the support leg 170. In other embodiments the slit 174 is offset from the middle of support leg 170. In yet other embodiments, the spacer 140 does not define a slit in one of the support legs 170. In one embodiment, for example, intermittent openings, such as holes or slots, are present in one of the support legs and are used to provide access to the interior space of the spacer during the process of depositing the spacer.

In alternative embodiments to those discussed in the previous paragraph, each support leg can be constructed of a top portion coupled to the first elongate strip and a bottom portion coupled to the second elongate strip in-set from the edges of the elongate strips, as described herein. In such an embodiment, the top portion of each support leg is configured to mutually engage with the bottom portion of support leg through fastening mechanisms known in the art. As an example, one portion of a support leg can define a spline or protrusion and the mating portion of the support leg can define a notched portion that is capable of engagement with the spline or protrusion.

Prior to engagement of the top portion of each support leg to the bottom portion of each support leg, the filler can be deposited onto the top surface of the second elongate strip in a location configured to be consistent with the interior cavity of the assembled spacer. Various configurations of this embodiment are described in U.S. Patent Publication 2009/0120036, which is herein incorporated by reference. Such publication refers to the support legs as "sidewalls" and the top portion and bottom portions are referred to as "first portion" and "second portion" respectively.

As visible in FIG. 2, channels 162 are defined between the elongate edges of the spacer 140 and the support legs 170. Generally the channels 162 are inset from the edges of the spacer 140. Returning now to FIG. 1, a first pocket 164 is defined by a channel 162 and a portion of the second surface 114 defined by the first sheet 110. A second pocket 166 is defined between a channel 162 and a portion of the fifth surface 122 defined by the second sheet 120.

The inset distance I of the support legs 170 defines the width of the pockets 164, 166. In some embodiments, the inset distance I is 0.01 inch (0.25 mm) or more. In one embodiment, the inset distance is 0.1 inch (2.54 mm) or less. In other embodiments, the inset distance I is 0.035 inch (0.89 mm) or more, 0.04 inch (1.02 mm) or more, and 0.07 inch (1.78 mm) or more. In the specific embodiment illustrated in the FIGS. 1 and 2, the inset distance I is about 0.075 inch (1.9 mm). In another embodiment, the inset distance I is about 0.0375 inch (0.95 mm). Sealant or adhesive generally occupies the pockets 164, 166 so that the sealant or adhesive thickness is typically the same thickness as the inset distance I. In different embodiments, the sealant or adhesive thickness is 0.08 inch (1.03 mm) or more, 0.5 inch (12.7 mm) or less, and about 0.175 inch (4.4 mm).

Sealant is generally deposited within the channels 162 when assembling the window assembly 100 so that gas and liquid are inhibited from entering the space disposed between the first and second sheets 110, 120. It is also possible for a non-sealant adhesive material to be deposited in the channels. In some embodiments, sealant is formed of a material having adhesive properties, such that the sealant acts to fasten the spacer 140 to at least the first sheet 110 and the second sheet 120. The material in each channel 162 contacts the inner faces of the first and second elongate strips in some embodiments, as well as contacts the inner face 114 or 122 of the adjacent sheet 110 or 120, and the adjacent support leg 170. Typically, the material is arranged to support the spacer 140 in an orientation normal to inner face 114, 122 of the first and second sheets 110, 120. If sealant is used, it also acts to seal the joint formed between the spacer 140 and the sheets 110, 120 to inhibit gas or liquid intrusion into the first air space 180 or the second air space 190. Examples of sealants include polyisobutylene (PIB), butyl, curable PIB, hot melt silicone, acrylic adhesive, acrylic sealant, and other Dual Seal Equivalent (DSE) type materials.

During one embodiment of an assembly method of a window unit, the sealant or adhesive is placed in the channels 162 and along the registration structure. The intermediary sheet, spacer or both are manipulated in order to wrap the spacer around the perimeter edge of the intermediary sheet. The first and second sheets 110, 120 are brought into contact with the elongate edges of the spacer 140. During this step, the sealant or adhesive is under some pressure. This pressure helps to strengthen the bond between the sealant or adhesive material and the first and second sheets 110, 120. Another effect of the pressure is that the material typically spills out of the channel slightly, thereby contacting the top and bottom surfaces of the elongate edges of the spacer 140 and providing a barrier at the juncture of the spacer 140 and the first and second sheets 110, 120. Such contact is not required in all embodiments. However, the additional contact area between material and the spacer 140 can be beneficial. For example, the additional contact area increases adhesion strength. The undulations of the elongate strips 150, 160 also aid in improving the adhesion with the material. Further details regarding embodiments of the assembly process and applicator apparatus will be described herein, and are also described in U.S. patent application Ser. No. 13/157,866, "WINDOW SPACER APPLICATOR", filed Jun. 10, 2011.

The first elongate strip 150 and the second elongate strip 160 are typically long and thin strips of a solid material, such as a metal or plastic. In one embodiment, the elongate strips 150, 160 are formed from material with repeating undulations, as will be further described herein. Recognizing that the undulations can be present in multiple embodiments, it is still possible to characterize portions of the elongate strips as planar in their overall shape, even when repeating undulations make up the planar structure. As visible in FIG. 2, the second elongate strip 160 is substantially planar, and the first elongate strip 150 has planar regions 151 connected to neck-down regions 154 with a respective ramp 158. The first elongate strip 150 has neck-down regions 154 towards the elongate edges of the spacer 140, such that the height of the spacer 140 is lower along the elongate edges of the spacer 140, so that the first 150 and second 160 elongate strips are closer to each other. In one embodiment, the support legs 170 are positioned within the neck-down region 154, and as a result, less material is required to construct the support legs 170 compared to if the support legs were in the taller portion of the spacer 140. Also, as a result of the neck-down regions 154, less sealant or adhesive material is required to fill the channels 162. The embodiment of the spacer 140 depicted in FIG. 2 has a neck-down region that has a width $W_N$ that is approximately 0.089 inches (2.26 mm), where the neck-down region is offset by a distance $H_N$ from the planar regions where the distance $H_N$ is approximately 0.044 inches (1.12 mm).

The first elongate strip 150 defines a registration structure 156 that enables positioning of the intermediary sheet 130 (See FIG. 1) during the assembly process by providing a structure which the intermediary sheet 130 can contact during the assembly process. As visible in FIG. 2, the registration structure 156 is a channel having a base 157 that has a width to accommodate the width of the intermediary sheet 130 (FIG. 1) and at least one ramped surface leading to the base 157. During assembly, adhesive can be deposited on the surface of the base 157 and the intermediary sheet 130 is positioned thereon. In some embodiments, the registration structure 156 includes two ramped surfaces, while in some embodiments there is only one ramped surface, and in other embodiments there are no ramped surfaces. While the registration structure 156 depicted in the current embodiment is a channel defined by the first elongate strip 150, registration structures can also include protrusions, openings, and combinations thereof that can also aid in positioning of the intermediary sheet 130 during assembly. The embodiment of the spacer 140 depicted in FIG. 2 has a registration structure 156 that has a base width $W_R$ of approximately 0.160 inches (4.06 mm). In this embodiment, the base 157 is offset from the planar regions 151 by a registration channel offset $H_R$ that is approximately 0.060 inches (1.52 mm) lower than the planar regions 151.

The channel of the registration structure 156 including ramped surfaces improves the ability to reel the spacer onto a spool compared to configurations having a protrusion or right-angle surfaces.

An example of a suitable metal for the first elongate strip 150 and the second elongate strip 160 is stainless steel. Other materials can also be used for the elongate strips 150, 160. An example of a suitable plastic is a thermoplastic polymer, such as polyethylene terephthalate. In some embodiments, a material with low or no permeability is may be used. Some embodiments include a material having a low thermal conductivity. In at least one embodiment, the first elongate strip 150 is constructed of a different material than the second elongate strip 160. In other embodiments, the first elongate strip 150 and the second elongate strip 160 are constructed of substantially similar materials.

In one embodiment, the thickness of the material of the elongate strip is 0.003 inch (0.076 mm) or less. In another embodiment, the thickness of the material is 0.0025 inch (0.063 mm) or less. In one embodiment, the thickness of the material is 0.0015 inch (0.038 mm) or more. In one embodiment, the thickness of the material is 0.001 inch (0.025 mm) or more. In one embodiment, the material thickness is about 0.002 inch (0.05 mm) or less.

In one embodiment, the thickness of the material of the elongate strip is 0.002 inch (0.05 mm) or more. In one embodiment, the material thickness is 0.003 inch (0.076 mm) or more. In one embodiment, the material thickness is 0.004 inch (0.10 mm) or more. In one embodiment, the material thickness is 0.005 inch (0.13 mm) or more. In one embodiment, the material of the elongate strip is 0.006 inch (0.15 mm) or less. In some embodiments, the material of at least one of the elongate strips is stainless steel and the material has one of the thickness dimensions described herein.

On their own, the first elongate strip 150 and the second elongate strip 160 are generally flexible, including both bending and torsional flexibility. In some embodiments, bending flexibility allows the spacer 140 to be bent to form non-linear shapes (e.g., curves). Bending and torsional flexibility also allows for ease of window manufacturing. Such flexibility includes either elastic or plastic deformation such that the first elongate strip 150 and the second elongate strip 160 do not fracture during installation into window assembly 100. In one embodiment, the first elongate strip 150 and the second elongate strip 160 are made of metal, for example stainless steel, and the window spacer is at least partially flexible. In some embodiments, the first elongate strip 150 and the second elongate strip 160 are substantially rigid. In some embodiments, the first elongate strip 150 and the second elongate strip 160 are flexible, but the resulting spacer 100 is substantially rigid. In some embodiments, the first elongate strip 150 and the second elongate strip 160 act to protect a filler 158 (which will be described below) from ultraviolet radiation.

In the embodiment depicted in FIG. 1, and also visible in FIG. 3, the first elongate strip 150 and the second elongate strip 160 has an undulating shape. In some embodiments, the first elongate strip 150 and the second elongate strip 160 are formed of a metal ribbon, such as stainless steel, which can then be bent into the undulating shape. One of the benefits of the undulating shape is that the flexibility of the first elongate strip 150 and the second elongate strip 160 is increased, including bending and torsional flexibility. The undulating shape resists permanent deformation, such as kinks and fractures. This allows the first elongate strip 150 and the second elongate strip 160 to be more easily handled during manufacturing without damaging them. The undulating shape can also increase the structural stability of the first elongate strip 150, the second elongate strip 160, or both to improve the ability of spacer 140 to withstand compressive and torsional loads. In addition, the undulating elongate strip will conform to the shape that it surrounds. Around corners, the outer undulating elongate strip will be under tension, while the inner undulating elongate strip will be under compression in some embodiments. As a result, it is easier to execute shaping of the spacer around an object such as a pane of glass. The use of undulations on the elongate strips allows the use of much thinner material than if material without undulations were used since the undulating material is more resistive to compressive forces and provides a larger surface area at its edge for bonding to the glass via the sealant or adhesive. As a result of the thinner material, much better thermal properties are observed in the resulting window assembly because less material in the spacer results in less material available to conduct heat. In addition, the increased surface area distributes forces present at the intersection of an edge of the elongate strip and a surface of the one or more sheets to reduce the chance of breaking, cracking or otherwise damaging the sheet at the location of contact.

Some possible embodiments of the undulating shape of the first elongate strip 150 and the second elongate strip 160 include sinusoidal, arcuate, square, rectangular, triangular, and other desired shapes. The shape of the undulating strip can be a relatively consistent waveform having a peak-to-peak amplitude, A as shown in FIG. 3, which can also be referred to as the overall thickness of the elongate strip 150, 160. The shape of the undulating strip can also have a relatively consistent peak-to-peak period, T as shown in FIG. 3. In some embodiments, the overall thickness A of the first elongate strip 150 and the second elongate strip 160 is about 0.005 inch (0.13 mm) or more, about 0.1 inch (2.5 mm) or less, about 0.02 inch (0.5 mm) or more, about 0.04 inch (1 mm) or less, about 0.01 inches (0.25 mm) or more, about 0.02 inches (0.5 mm) or less, and 0.012 inch (0.3 mm) in one embodiment.

In one embodiment, including the embodiment depicted in FIG. 1 and visible in FIG. 3, the peak-to-peak period of the undulations in the first and second elongate strips 150, 160 is 0.012 inch (0.3 mm) or more. In some embodiments, the peak-to-peak period of the undulations is 0.01 inch (2.5 mm) or less, 0.05 inch (1.27 mm) or less, or 0.036 inch (0.91 mm). Larger waveforms can be used in other embodiments. Other embodiments can include other dimensions.

The dimensions of the peak-to-peak period and peak-to-peak amplitude of the second elongate strip impacts the performance and shape of the spacer around corners. Combinations of the minimum values for the amplitude and period described herein enable the formation of a corner without distorting or breaking the second elongate strip. In one embodiment, a peak-to-peak period is 0.012 inch (0.3 mm) or more and the amplitude is 0.005 inch (0.13 mm) or more. In one embodiment, a peak-to-peak period is 0.012 inch (0.3 mm) or more and the amplitude is 0.01 inches (0.25 mm) or more.

Some embodiments of the first elongate strip 150 and the second elongate strip 160 are formed of materials other than metals, and can be formed by more appropriate processes, such as molding. Note that while the FIGS. 1, 2, and 3 show elongate strips 150, 160 having similar undulations, it is contemplated that the first elongate strip 150 may have an undulating shape that is much larger than the undulating shape of the second elongate strip 160, or vice versa. Another possible embodiment includes a flat elongate strip without undulations combined with an elongate strip with an undulating shape. Other combinations and arrangements are also possible.

In some embodiments, the structure of the spacer 140 results in fluid communication between the two air spaces. The first elongate strip 150 includes openings to both the first air 180 space and the second air space 190, which permit air flow between the first 180 and second 190 air spaces through the spacers 140 interior region. The first elongate strip 150 defines a plurality of apertures 152. Apertures 152 allow gas and moisture to pass through the first elongate strip 150. As a result, the first air space 180 and the second air space 190 are in fluid communication and, as such, moisture located within the first air space 180 and the second air space 190 is allowed to pass through the spacer 140 where it is removed by desiccant in the filler 158.

Another consequence of the first and second spaces being in fluid communication is that the two air-tight seals instead of four air-tight seals are required to maintain the isolation of the first and second spaces from the exterior atmosphere. As a result, there are half as many potential points of failure in the sealing structure. In addition, the quantity of sealant or adhesive and filler material is reduced.

Also, wind load is transferred directly from the first sheet of material to the second sheet of material in constructions where there is fluid communication between the first and second air spaces. In contrast, in a triple pane construction where the first and second spaces are sealed from each other, the wind load is transferred from the first sheet to the intermediary sheet and then to the second sheet. As a result, the intermediary sheet needs to be mechanically capable of bearing the wind load in such a construction. In contrast, in embodiments where there is fluid communication between the first and second air spaces, the intermediary sheet can be constructed from a thinner material and using different material than the first and second sheets, since the intermediary sheet will not need to withstand wind load.

In another embodiment, apertures 152 are used for registration. In yet another embodiment, apertures 152 provide reduced thermal transfer. In one example, apertures 152 have a diameter in a range from about 0.002 inches (0.051 mm) to about 0.050 inches (1.27 mm). In one example, apertures 152 have a diameter of 0.030 inch (0.76 mm) and in another example, the apertures 152 have a diameter of 0.015 inch (0.38 mm). In various embodiments, the apertures 152 have a center-to-center spacing of 0.002 inch (0.051 mm) or more, 1 inch (25.4 mm) or less, and for example 0.060 inch (1.52 mm). Apertures 152 are made by any suitable method, such as cutting, punching, drilling, laser forming, or the like.

In one embodiment, gilling may be used to form and define the apertures 152. Generally, "gilling" refers to the introduction of a plurality of discontinuous slits on the surface of the first elongate strip 150 prior to forming the undulations of the first elongate strip 150. One manner of introducing the plurality of discontinuous slits on the first elongate strip 150 is by passing the first elongate strip 150 through a pair of rollers, where at least one roller defines a plurality of discontinuous protrusions and a mating roller defines a plurality of discontinuous mating receptacles. After the introduction of the plurality of discontinuous slits to the first elongate strip 150, undulations can be formed in the first elongate strip 150. In one embodiment the length of each slit is approximately 0.125 inches (3.17 mm) in length. In one embodiment, the apertures are elongate slits.

Figure 13:
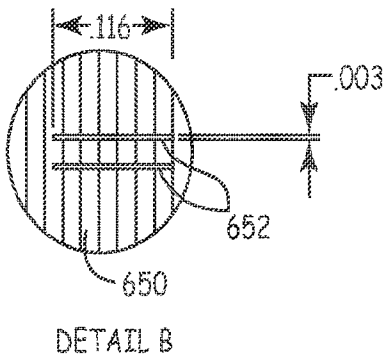
FIG. 13 depicts a view of Detail B from FIG. 12.
Figure 12:
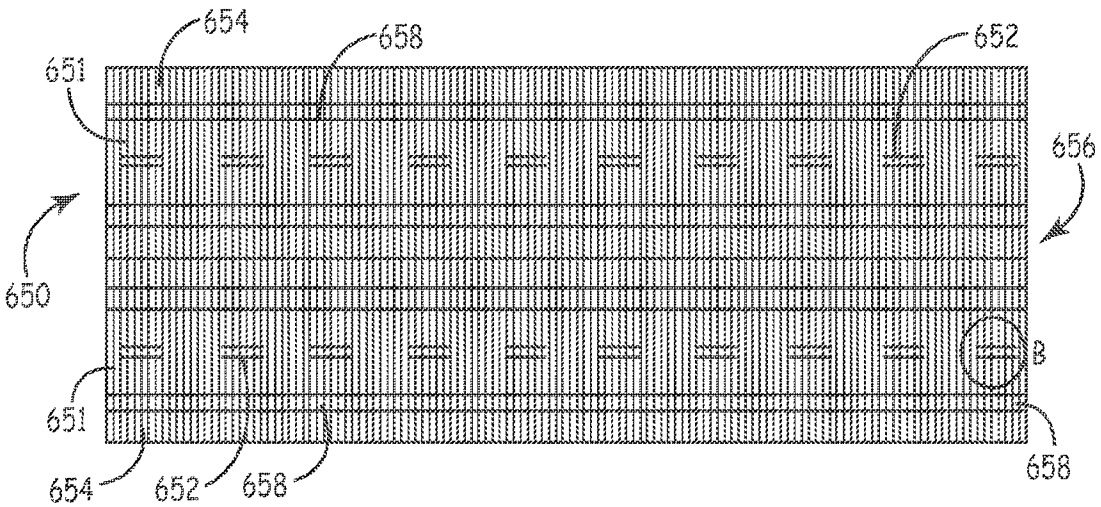
FIG. 12 depicts a top view of a portion of a first elongate strip, consistent with the technology disclosed herein.

FIG. 12 depicts a top view of a portion of a first elongate strip 650 after gilling, formation of undulations, and further shaping. FIG. 13 depicts a view of Detail B from FIG. 12. The first elongate strip 650 has planar regions 651 leading to neck-down regions 654 via respective ramps 658. The first elongate strip 650 also defines a registration structure 656 and a plurality of discontinuous slits 652 along the lengths of the planar regions 651. In this particular embodiment, each discontinuous slit is approximately 0.003 inches (0.076 mm) wide and 0.116 inches (2.95 mm) in length.

Some embodiments include filler 158 that is arranged between the first elongate strip 150 and the second elongate strip 160. In some embodiments, filler 158 is a deformable material. In some embodiments, filler 158 is a desiccant that acts to remove moisture from interior cavity 172. Desiccants include molecular sieve and silica gel type desiccants. One example of a desiccant is a beaded desiccant, such as PHONOSORB® molecular sieve beads manufactured by W. R. Grace & Co. of Columbia, Md. If desired, an adhesive is used to attach beaded desiccant between first elongate strip 150 and the second elongate strip 160.

In some embodiments, the filler 158 provides support to the first elongate strip 150 and the second elongate strip 160. In embodiments that include the filler 158, the filler 158 occupies an interior cavity or interior space 172 defined between the first and second elongate strips 150, 160. The presence of the filler 158 can reduce thermal transfer through the first and second elongate strips 150, 160. In some embodiments, the filler 158 is a matrix desiccant material that not only acts to provide structural support between the elongate strips 150, 160, but also removes moisture from the interior cavity 172.

Examples of a filler material include adhesive, foam, putty, resin, silicone rubber, or other materials. Some filler materials are a desiccant or include a desiccant, such as a matrix material. Matrix material includes desiccant and other filler material. Examples of matrix desiccants include those manufactured by W.R. Grace & Co. and H.B. Fuller Corporation. In some embodiments a beaded desiccant is combined with another filler material.

In some embodiments, the filler 158 is made of a material providing thermal insulation. The thermal insulation reduces heat transfer through the spacer 140 between sheets and between the interior cavity 172 and the exterior side of the spacer 140.

Figure 4:
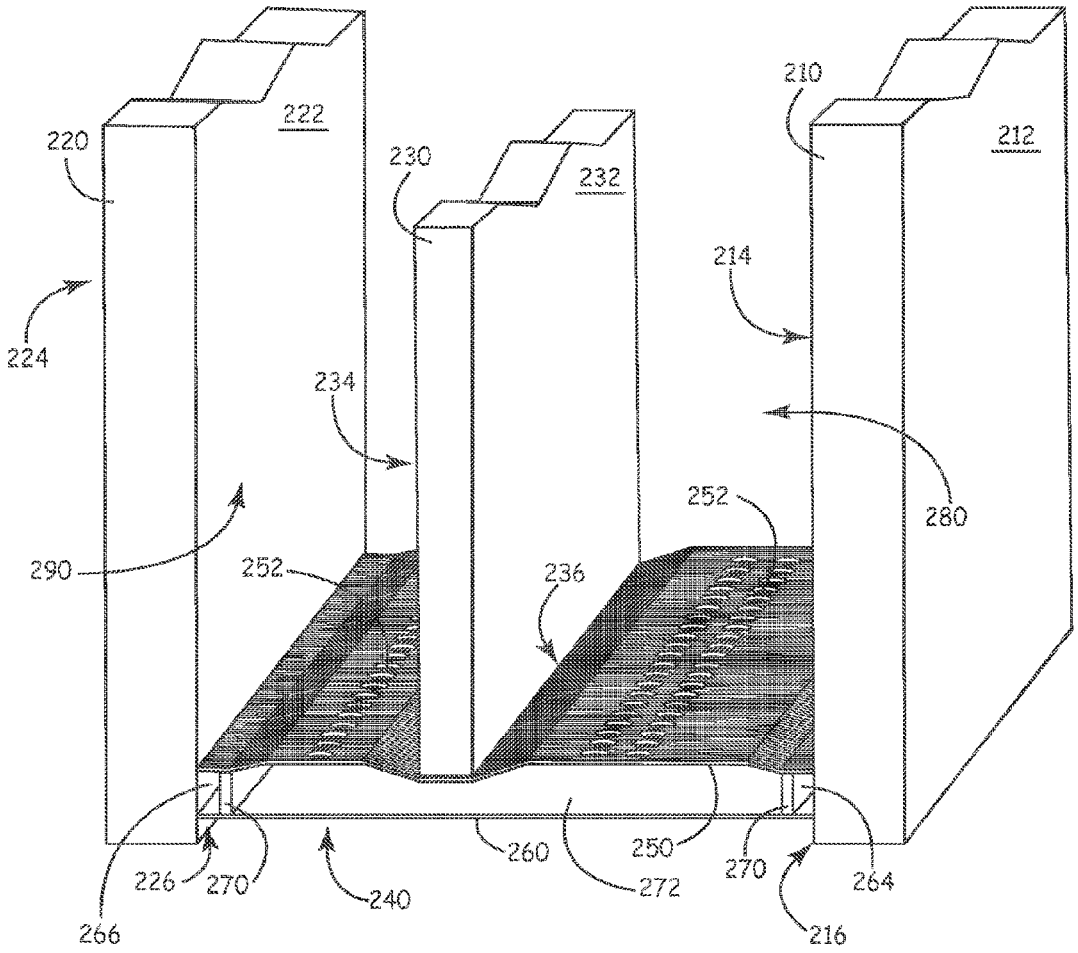
FIG. 4 depicts a partial perspective view of another implementation of a window assembly described herein.
Figure 5:
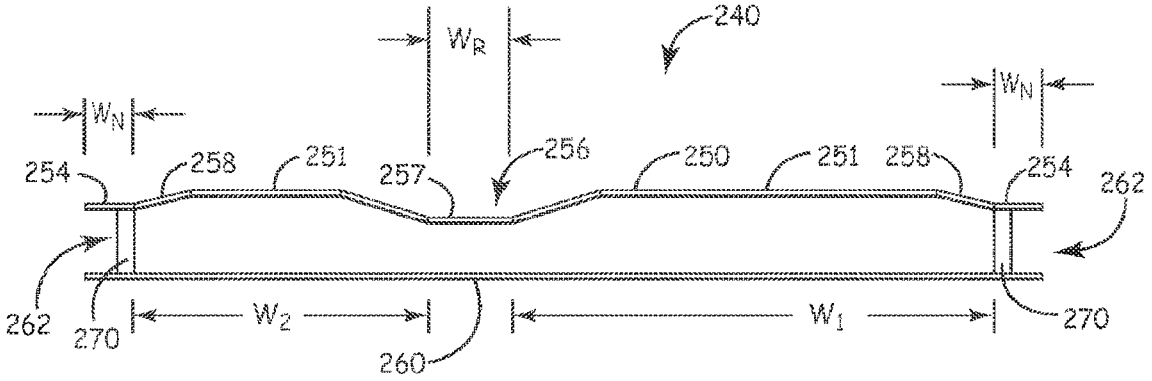
FIG. 5 depicts a cross-sectional view of a spacer component of FIG. 4, consistent with the technology disclosed herein.

FIG. 4 depicts a partial perspective view of another implementation of the technology described herein. FIG. 5 depicts a cross-sectional view of the component of FIG. 4. This particular implementation is consistent with what will be referred to as an asymmetrical triple pane window assembly.

Window assembly 200 includes a first sheet 210, a second sheet 220, an intermediary sheet 230 and a spacer 240 disposed between the first sheet 210 and the second sheet 220. The first sheet 210 defines a first sheet surface 212, a second sheet surface 214, and a perimeter 216. The intermediary sheet defines a third sheet surface 232, a fourth sheet surface 234, and a perimeter 236. The second sheet 220 defines a fifth sheet surface 222, a sixth sheet surface 224, and a perimeter 226. Similar to FIG. 1, FIG. 4 is a partial view of the window assembly 200 and depicts the spacer 240 disposed adjacent to the bottom perimeter 216 of the first sheet and the bottom perimeter 226 of the second sheet 210. It should be understood that the spacer 240 is disposed between the first sheet 210 and the second sheet 220 adjacent to the entire perimeters of the sheets 210, 220. In the embodiment of FIGS. 4-5, the intermediary sheet 230 is positioned closer to the second sheet 220 than the first sheet 210, so the width of a first air space 280 is larger than the width of the second air space 290.

In one implementation of this particular window assembly 200, the first sheet 210 is the exterior side of the window assembly 200 and the second sheet 220 is on the interior side of the window assembly 200. As such, the first air space 280 may be referred to as the "exterior gap" and the second air space 290 may be referred to as the "interior gap". In the embodiment of FIGS. 4-5, the exterior gap 280 width is different from the interior gap 290 width, which is visible in FIG. 5. In one embodiment, the interior gap is wider than the exterior gap. In one embodiment, the exterior gap 280 has a width $W_1$ of approximately 1.000 inch (25.4 mm), and the interior gap 290 has a width $W_2$ of approximately 0.625 inch (15.85 mm).

The exterior gap width can range from 0.5 inches (12.7 mm) to 2 inches (50.8 mm) in a variety of embodiments. Many other options are possible for the exterior gap width $W_1$. In some embodiments the exterior gap width or width of the first space is about ½ inch (12.7 mm) or more, about ⅝ inch (15.9 mm) or more, ¾ inch (19.05 mm) or more, and 1 inch (25.4 mm) or more. In some embodiments, $W_1$ is about 2 inches (50.8 mm) or less, about 1½ inch (38.1 mm) or less, about 1¼ inch (3.2 cm) or less, and about 1 inch (2.5 cm). In some embodiments, $W_1$ is about 1 inch (2.5 cm). In some embodiments, $W_1$ is ¾ inch (1.9 cm) or more and 1¼ inch (3.2 cm) or less.

There are also many options for the interior gap width $W_2$. In some embodiments, $W_2$ is about ⅛ inch (3.2 mm) or more, ¼ inch (6.3 mm) or more, ⅜ inch (9.5 mm) or more, and ½ inch (12.7 mm) or more. In some embodiments, $W_2$ is about 1 inch (2.5 cm) or less, about ⅞ inch (2.2 cm) or less, and about ¾ inch (1.9 cm) or less. In some embodiments, $W_2$ is about ⅝ inch (15.9 mm). In some embodiments, $W_2$ is about ½ inch (12.7 mm) or more and ¾ inch (1.9 cm) or less.

The spacer 240 includes a first elongate strip 250, a second elongate strip 260, and support legs 270 that mutually define an interior cavity 272 that may contain a filler 258. The spacer 240 is disposed between the first sheet 210 and the second sheet 220 to keep the sheets 210, 220 spaced from each other. The first and second elongate strips 250, 260 each have elongate parallel edges. The support legs 270 are each spaced inwardly from the elongate edges of the first and second elongate strips by an offset distance to form a channel on each side of the spacer. In one embodiment, sealant material or adhesive material is positioned in the channels. The sealant or adhesive material contacts the first elongate strip, the second elongate strip, one of the support legs and the first or second sheet of material.

The inset distance I (See FIG. 2) of the support legs 270 defines the width of the pockets 264, 266. In some embodiments, the inset distance I is 0.01 inch (0.25 mm) or more. In one embodiment, the inset distance is 0.1 inch (2.54 mm) or less. In other embodiments, the inset distance I is 0.035 inch (0.89 mm) or more, 0.04 inch (1.02 mm) or more, and 0.07 inch (1.78 mm) or more. In one embodiment, the inset distance I is about 0.075 inch (1.9 mm). In another embodiment, the inset distance I is about 0.0375 inch (0.95 mm). Sealant or adhesive generally occupies the pockets 264, 266 so that the sealant or adhesive thickness is typically the same thickness as the inset distance I. In different embodiments, the sealant or adhesive thickness is 0.08 inch (1.03 mm) or more, 0.5 inch (12.7 mm) or less, and about 0.175 inch (4.4 mm).

As visible in FIG. 5, the second elongate strip 260 is substantially planar, despite being made up of repeating undulations. Similar to the embodiment of the spacer depicted in FIG. 2, the first elongate strip 250 has planar regions 251 connected to neck-down regions 254 with respective ramps 258. The embodiment of the spacer 240 depicted in FIG. 5 has a neck-down region 254 that has a width $W_N$ that is approximately 0.089 inches (2.26 mm). The first elongate strip 250 defines a registration structure 256 that enables positioning of the intermediary sheet 230 (See FIG. 4) during the assembly process. As visible in FIGS. 4 and 5, and similar to the embodiment depicted in FIG. 1, the registration structure 256 is a channel having a base 257 that has a width $W_R$ to accommodate the width of the intermediary sheet 230 (FIG. 5) and at least one ramped surface leading to the base 257. In some embodiments, the registration structure 156 includes two ramped surfaces, while in some embodiments there is only one ramped surface, and in other embodiments there are no ramped surfaces. The embodiment of the spacer 240 depicted in FIG. 5 has a registration structure 256 that has a base 257 width $W_R$ of approximately 0.160 inches (4.06 mm). In one embodiment, the registration structure is continuous along the length of the spacer. In one embodiment, the registration structure is integral with and formed by the first elongate strip.

As visible in FIG. 4, the first elongate strip 250 defines a plurality of apertures 252, similar to the embodiment depicted in FIG. 1, which allow the exterior gap 280 and the interior gap 290 to be in fluid communication. Particular to this embodiment, the side of the first elongate strip 250 corresponding to the interior gap 190 defines more apertures 252 than the side of the elongate strip 250 corresponding to the exterior gap 290.

One or both of the first and second elongate strips 250 and 260 have undulations as described herein with respect to elongate strips 150 and 160 in various embodiments.

Figure 6:
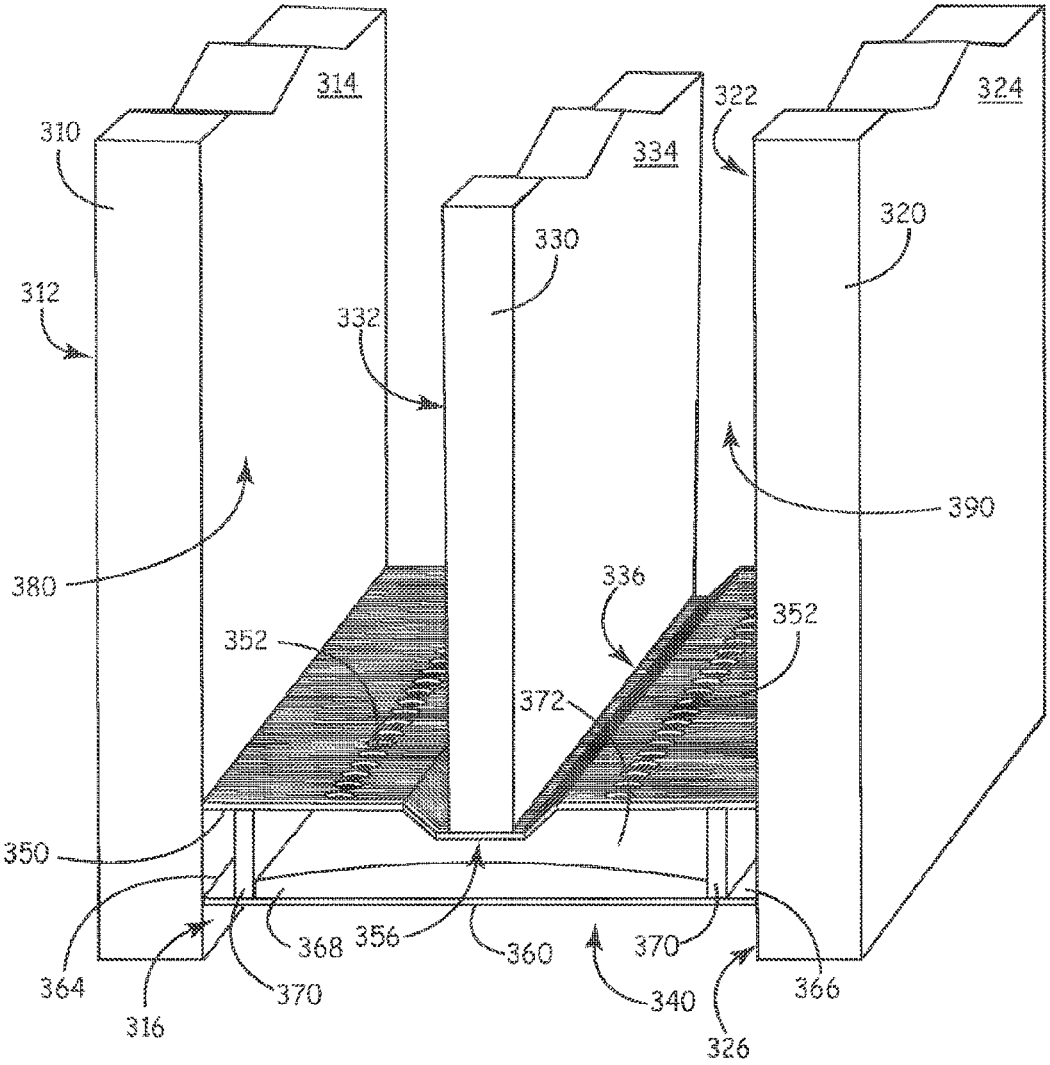
FIG. 6 depicts a partial perspective view of yet another implementation of the technology described herein.
Figure 7:
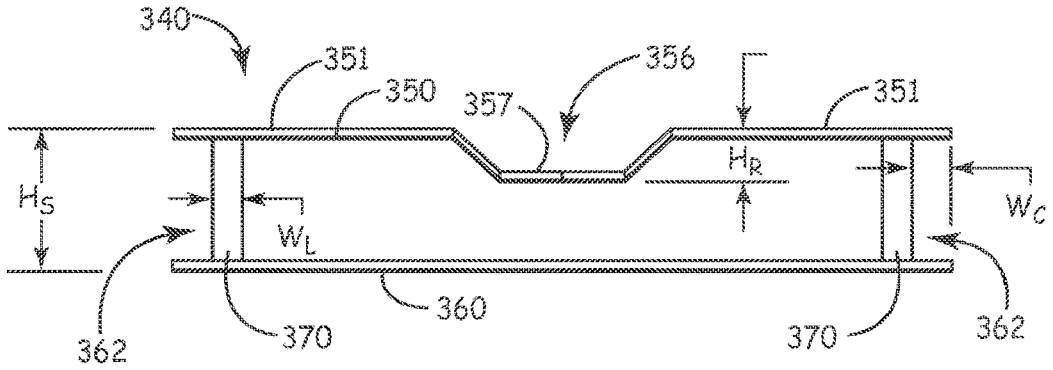
FIG. 7 depicts a cross-sectional view of a spacer component of FIG. 6, consistent with the technology disclosed herein.

FIG. 6 depicts a perspective view of yet another triple pane window assembly. FIG. 7 depicts a cross-sectional view of a spacer component of FIG. 6.

A window assembly 300 includes a first sheet 310, a second sheet 320, an intermediary sheet 330 and a spacer 340 disposed between the first sheet 310 and the second sheet 320. The first sheet 310 defines a first sheet surface 312, a second sheet surface 314, and a perimeter 316. The intermediary sheet defines a third sheet surface 332, a fourth sheet surface 334, and a perimeter 336. The second sheet 320 defines a fifth sheet surface 322, a sixth sheet surface 324, and a perimeter 326. Similar to the embodiment depicted in FIG. 1, the intermediary sheet 330 is positioned substantially equidistant to the first sheet 310 and the second sheet 320, so the size of a first air space 380 is equal to the size of the second air space 390, although such configuration is not necessarily integral to the design of the window assembly 300.

The spacer 340 generally has a first elongate strip 350, a second elongate strip 360, and support legs 370 that define an interior cavity 372 configured to receive a filler material 368. A first pocket 364 is defined between a portion of the second surface 314, the first elongate strip 350, the second elongate strip 360, and the support leg 370. A second pocket 366 is defined between a portion of the fifth surface 322, the first elongate strip 350, the second elongate strip 360, and the support leg 370.

Figure 8:
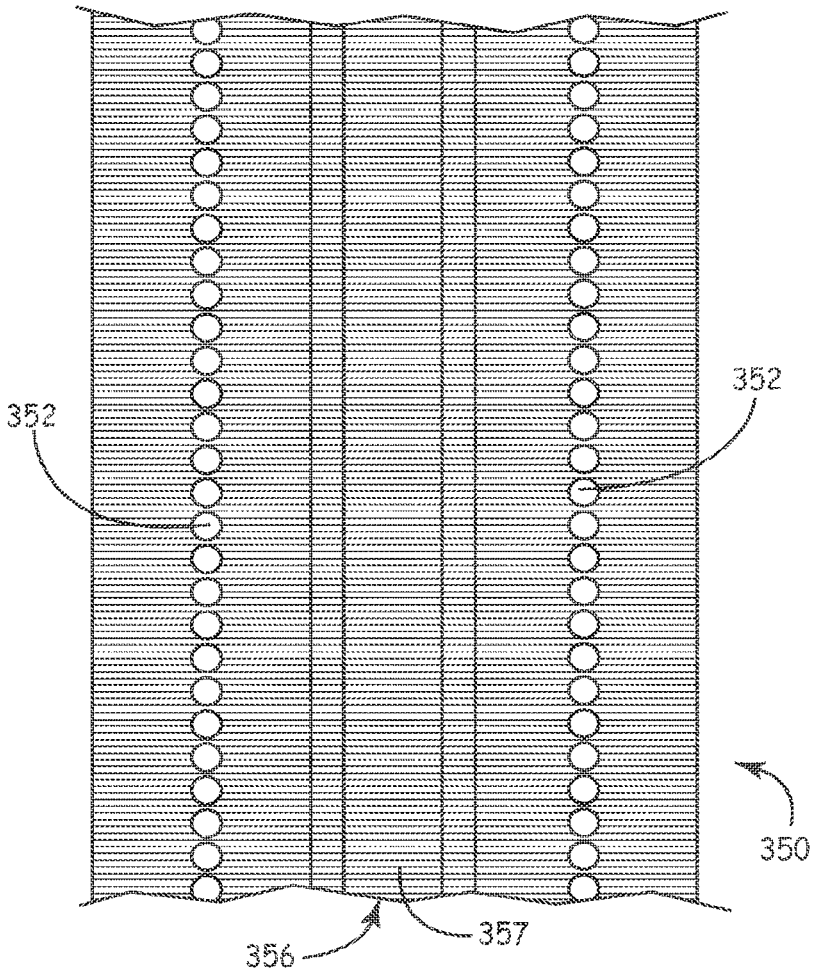
FIG. 8 depicts a top view of the component of FIG. 6, consistent with the technology disclosed herein.

Visible in FIG. 6, the first elongate strip 350 defines a plurality of apertures 352, similar to the embodiment depicted in FIG. 1, which allow the first air space 380 and the second air space 390 to be in fluid communication. Also similar to the embodiment depicted in FIG. 1, the side of the first elongate strip 350 corresponding to the second air space 380 defines a similar number of apertures 352 as the side of the elongate strip 350 corresponding to the first air space 380. FIG. 8 depicts a schematic top view of the component of FIGS. 6 and 7, such that the apertures 352 are directly visible.

As visible in FIG. 7, the second elongate strip 360 is substantially planar. The first elongate strip 350 has planar regions 351 on each side of a registration structure 356 having a base 357 defined substantially central to the width of the spacer 340. The base 357 is offset below the planar regions by an offset distance $H_R$, which is approximately 0.060 inches (1.52 mm) in the current embodiment. This particular embodiment does not define neck-down regions as the embodiments depicted in FIGS. 1-5. The support legs 370 are approximately 0.030 inches (0.76 mm) wide ($W_L$) in this embodiment, and the height $H_S$ of the spacer is approximately 0.200 inches (5.08 mm) tall. Channels 362 defined by the support legs 370 and the first and second elongate strips 350, 360 have a width $W_C$ of approximately 0.075 inches (1.90 mm).

One or both of the first and second elongate strips 350 and 360 have undulations as described herein with respect to elongate strips 150 and 160 in various embodiments.

Test Results

A spacer configuration consistent with FIGS. 6 and 7 was evaluated to determine its linear thermal transmission coefficient ψ (W/mK) using four different window frame materials: metal, timber-metal, timber, and PVC (polyvinylchloride). The analysis was based on the conditions defined in the IFT Guideline WA (ift-Guideline WA 08engl/1, November 2008: Thermally improved spacers, Part 1: Determination of representative $\psi_{rep}$—values for profile sections of windows).

The elongate strips were stainless steel having a thickness of approximately 0.01 inches (0.025 mm). The interior cavity 372 of the spacer was 40% filled with a butyl matrix including a desiccant. The supports legs 370 were made of polyacrylamide.

The representative linear heat transfer coefficients $\psi_{rep}$ apply to typical frame profiles and glazing for the determination of thermal transmittance Uw of windows. They are determined using the conditions (frame profile, glazing, glass rebate (depth), Insulating glass back sealant back cover, primary and secondary sealant type) defined in the ift guideline WA08/1. Results were compared to known spacer configurations and are provided in Table 1.

TABLE 1

| | Frame Types (Triple Glazing Units Only) in (W/mK) | | | |
|---|---|---|---|---|
| Spacer System | Metal | PVC | Timber | Timber/Metal |
| Aluminum | 0.111 | 0.075 | 0.086 | 0.097 |
| Stainless Steel | 0.063 | 0.048 | 0.053 | 0.058 |
| Comparative 1 | 0.056 | 0.042 | 0.046 | 0.051 |
| Comparative 2 | 0.051 | 0.041 | 0.043 | 0.047 |
| Comparative 3 | 0.045 | 0.038 | 0.039 | 0.042 |
| Comparative 4 | 0.042 | 0.037 | 0.037 | 0.04 |
| Comparative 5 | 0.036 | 0.033 | 0.032 | 0.035 |
| Comparative 6 | 0.034 | 0.032 | 0.031 | 0.033 |
| Tested Embodiment | 0.034 | 0.032 | 0.031 | 0.033 |

The Comparative 1 and Comparative 6 spacer systems were the SwissSpacer™ and Swisspacer-V™ spacer systems, respectively, which are sold by SWISSPACER in Kreuzlingen, Switzerland. The Comparative 2 spacer system was the TGI® spacer system, which is sold by Technoform in Twinsburg, Ohio. The Comparative 3 spacer system was the Thermix TX.N® spacer system, which is sold by Thermix in Ravensburg, Germany. The Comparative 4 spacer system was the TPS® spacer system which is sold by Viridian in Auckland, New Zealand. The Comparative 5 spacer system was the Super Spacer® TriSeal™ space system which is sold by Edgetech in Cambridge, Ohio.

In the tested embodiment, the spacer extends from a first pane to a second pane, with the intermediate pane disposed there-between. A first elongate strip of the spacer extends from the first pane to the second pane. The first elongate strip is a metal and, more particularly, stainless steel. The first elongate strip defines lateral undulations that extend between the first pane and the second pane. A registration structure is defined in the first elongate strip, which is a recessed surface configured to receive an intermediate pane. A second elongate strip is substantially parallel to the first elongate strip, extends from the first pane to the second pane, and is also made of a metal particularly, stainless steel. The second elongate strip can also define lateral undulations extending between the first pane and the second pane. The second elongate strip can be referred to as the outer elongate strip, as it is configured to face outside of a window pane assembly. As follows, the first elongate strip can be referred to as the inner elongate strip, as it is configured to face the interior of a window pane assembly.

A cavity is defined between the first elongate strip and the second elongate strip. As such, the cavity is configured to extend between the first pane and the second pane. The cavity is also configured to extend outside of the perimeter of the intermediate pane. A desiccant is disposed in the cavity. Support legs extend between the first elongate strip and the second elongate strip to define sidewalls of the cavity. The support legs are generally made of an extrudable material, particularly, nylon. The support legs are offset from the longitudinal edges of the elongate strips and the panes. As such, a first gap is defined between the first pane, a first support leg, the first elongate strip and the second elongate strip. Likewise, a second gap is defined between the second pane, a second support leg, the first elongate strip and the second elongate strip.

Apertures are defined in the first elongate strip on each side of the registration structure that lead to the cavity of the spacer. As such, the airspaces on each side of the intermediate pane are in fluid communication. Because a desiccant is disposed in the cavity, it follows that the airspaces on each side of the intermediate pane are also in fluid communication with the desiccant.

Figure 9:
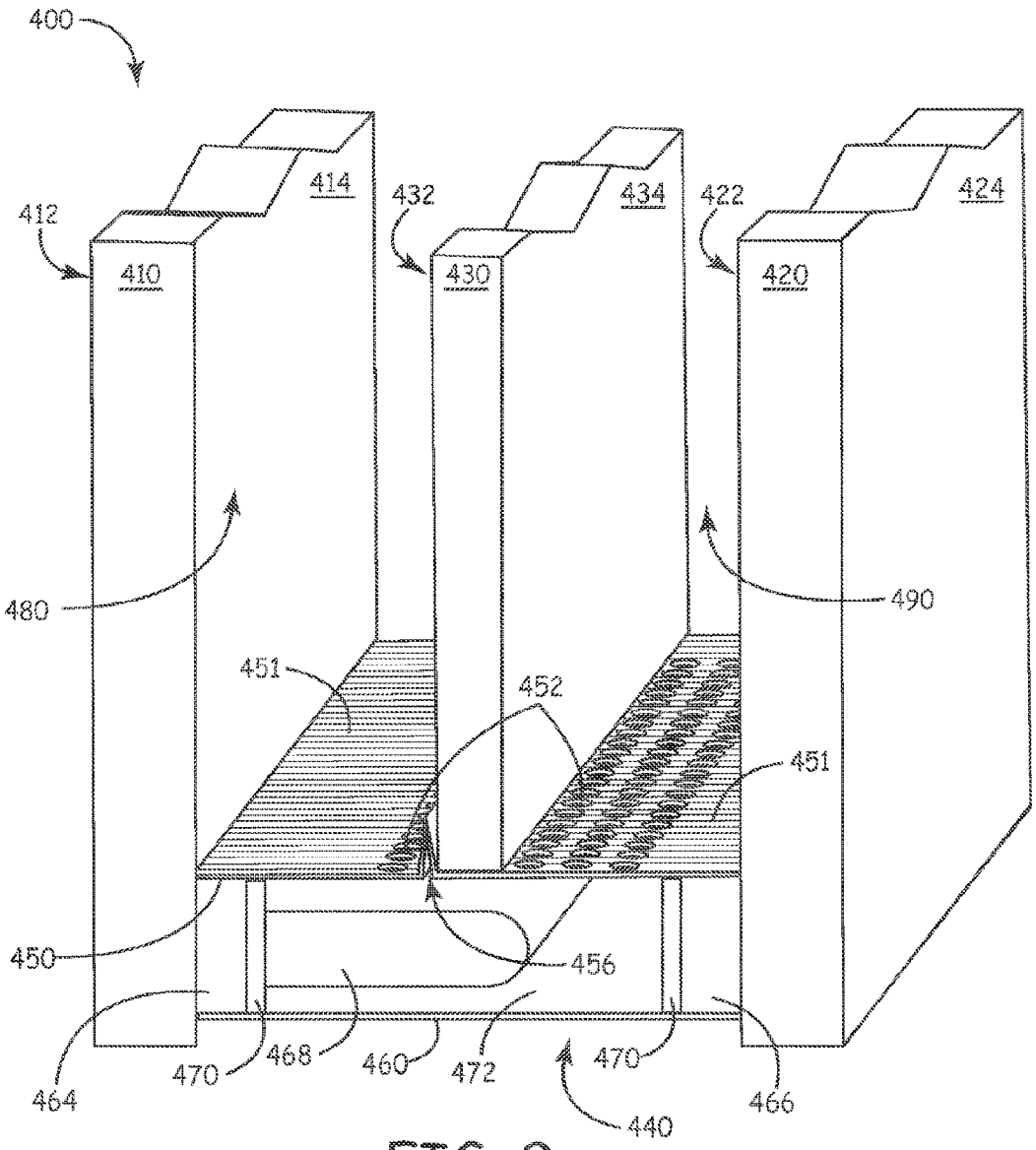
FIG. 9 depicts a partial perspective view of another implementation of the technology disclosed herein.

FIG. 9 depicts a perspective view of another implementation of the technology disclosed herein. A window assembly 400 includes a first sheet 410, a second sheet 420, an intermediary sheet 430 and a spacer 440 disposed between the first sheet 410 and the second sheet 420. The first sheet 410 defines a first sheet surface 412 and a second sheet surface 414. The intermediary sheet defines a third sheet surface 432 and a fourth sheet surface 434. The second sheet 420 defines a fifth sheet surface 422 and a sixth sheet surface 424. The spacer 440 is sealably disposed between the first sheet 410 and the second sheet 420.

The spacer 440 generally has a first elongate strip 450, a second elongate strip 460, and support legs 470 that define an interior cavity 472 configured to receive a filler material 468. A first pocket 464 is defined between a portion of the second surface 414, the first elongate strip 450, the second elongate strip 460, and the support leg 470. A second pocket 466 is defined between a portion of the fifth surface 422, the first elongate strip 450, the second elongate strip 460, and the support leg 470.

The second elongate strip 460 is substantially planar. The first elongate strip 450 has planar regions 451 on each side of a registration structure 456, where the registration structure 456 is a protrusion extending above the surface of the first elongate strip 450. The registration structure 456 is configured to help guide the intermediary sheet 430 to an appropriate location on the surface of the first elongate strip 450. In this embodiment the planar region 451 of the first elongate strip 450 is configured to receive the intermediary sheet 430, adjacent to the registration structure 456. This particular embodiment does not define neck-down regions. Similar to the embodiment depicted in FIG. 1, the intermediary sheet 430 is positioned substantially equidistant to the first sheet 410 and the second sheet 420, so the size of a first air space 480 is equal to the size of the second air space 490.

The first elongate strip 450 defines a plurality of apertures 452, which allow the first air space 480 and the second air space 490 to be in fluid communication. The first elongate strip 450 defines more apertures in communication with the second air space 490 than apertures in communication with the first air space 480.

Figure 10:
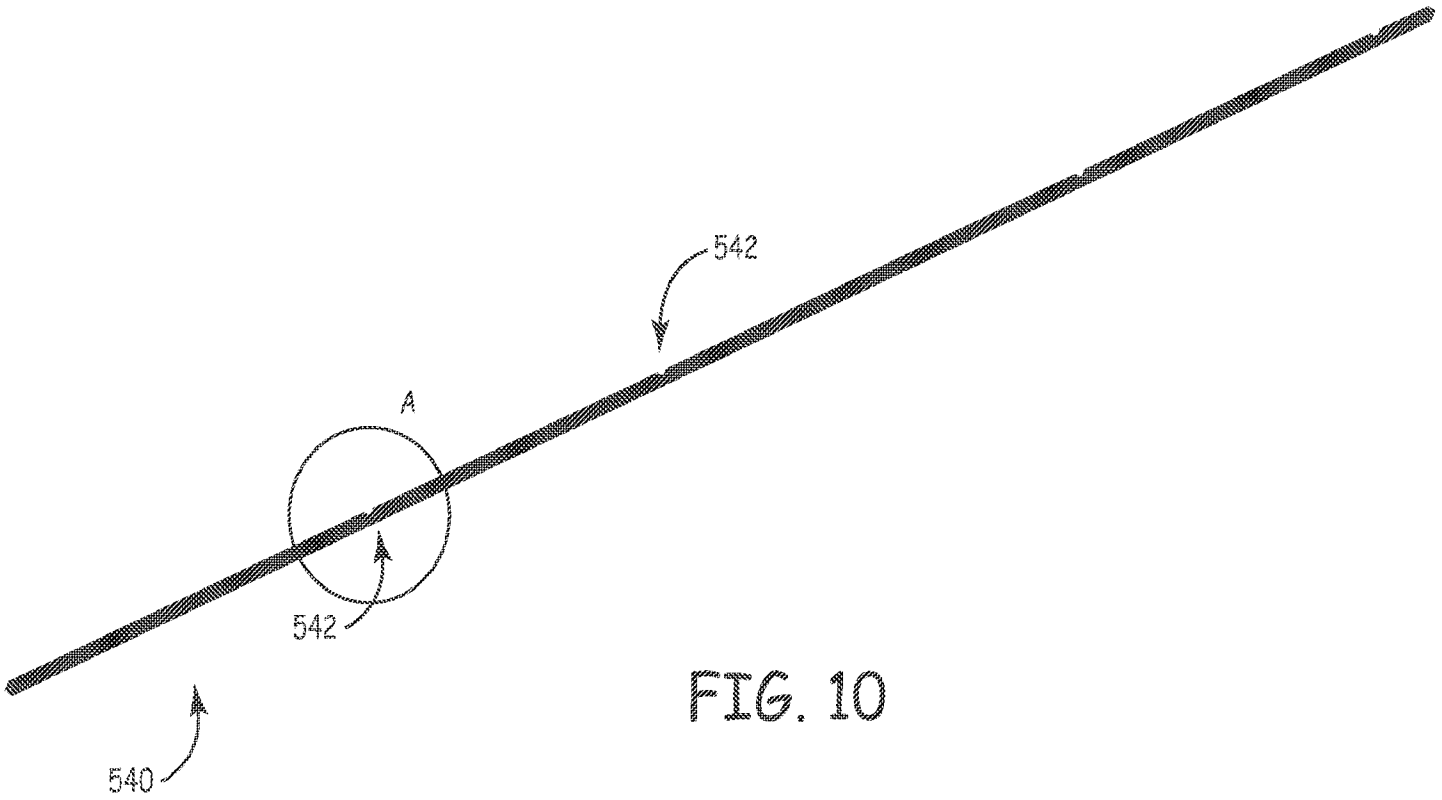
FIG. 10 depicts a partial perspective view of a component consistent with the technology disclosed herein.
Figure 11:
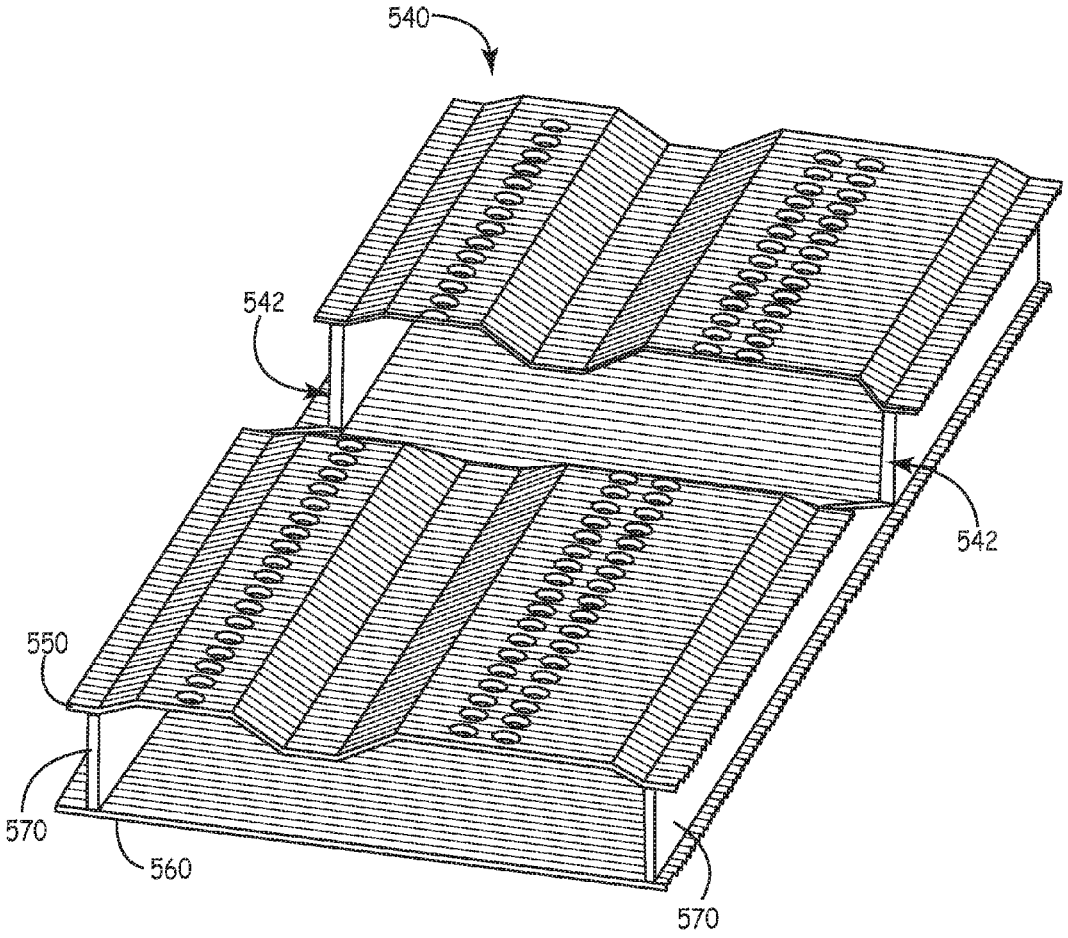
FIG. 11 depicts an enlarged view of a portion of the component depicted in FIG. 10, consistent with the technology disclosed herein.

One or both of the first and second elongate strips 450 and 460 have undulations as described herein with respect to elongate strips 150 and 160 in various embodiments. FIG. 10 depicts a perspective view of a spacer consistent with the technology disclosed herein. FIG. 11 depicts an enlarged view of Detail A of the component depicted in FIG. 10, consistent with the technology disclosed herein. Generally spacers 540 can be produced as a continuous part, and then cut to an appropriate length after forming. In some embodiments the spacer 540 is formed to have a length sufficient to extend along an entire perimeter of a window, such as depicted in FIG. 10. In other embodiments, the spacer is formed to have a length sufficient for a single side or portion of a window.

The sheets of material used in windows can be a variety of shapes and may have corners. In multiple embodiments the sheets are rectangular and have four ninety degree angles. As such, the spacers 540 can be configured to be positioned adjacent to the perimeter of a sheet including accommodating the shape of the corners. As such, corner notches 542 can be defined along the length of the spacer 540 that are configured to correspond with the location of the corners of the sheets of material. FIG. 11 depicts a detailed view of a corner notch 542 from FIG. 10. In one embodiment, the first elongate strip 550 of the spacer assembly 540 forms a true corner angle that conforms closely to the corner angle of the sheet in the assembled window unit, such as forming a 90 degree angle, as true as possible and without a radius, at the corners.

The notches 542 are generally V-shaped. Each notch 542 extends through the first elongate strip 550 and the support legs 570. In one embodiment, the notch 542 defines an angle that is about 90 degrees.

The corner notching or corner registration process allows the formation of a true corner, either ninety degrees or another angle, by the first elongate strip 550 of the spacer and therefore allows the use of a true ninety degree corner on the intermediary sheet of material such as glass. As a result, it is not necessary to create a radius at each corner of the sheet, which is significantly more efficient in the glass cutting process than creating a radius at corners. At the corners of the window assembly, the second elongate strip 560 is bent and forms a radius in some embodiments. In one embodiment, the radius of the second elongate strip 560 after being applied around a corner of a sheet is about 0.25 inch (6.35 mm). In one embodiment, the radius of the second elongate strip 560 at a corner is about 0.1 inch (2.54 mm) or more. In one embodiment, the radius of the second elongate strip 560 at a corner is about 0.5 inch (12.7 mm) or less. An advantage of this configuration is that the equipment that applies sealant or adhesive is not required to come to a stop, but can simply slow down, as it travels around the corners of the window assembly.

In at least one embodiment, the spacer 540 is fed into a corner registration mechanism to define the corner notches 542. The corner registration mechanism is adapted to score the spacer 540 at defined locations. In the subject embodiment, the corner registration mechanism is adapted to cut notches 542 into the spacer 540 at given intervals. In the notching process, a portion of the first elongate strip is removed and a portion of the two support legs is removed at each notch location. In one embodiment, the system includes an automated control system that is programmed with the dimensions of the spacers that are required for making the next window assemblies, and is operatively coupled to the components of the assembly system. The automated control component can thereby calculate the specific locations in the roll where particular spacer lengths will begin and end, and the corner locations for those spacers. The intervals between the adjacent notches 542 are chosen based on the dimensions of the sheets. As the spacer 540 is fed through the corner registration mechanism, the notches 542 are cut by the corner registration mechanism at the corner locations.

Some embodiments of spacer are made according to the following process. Elongate strips are typically formed first. The elongate strips are made of a material, such as metal, that is formed into a thin and long ribbon (or multiple ribbons), such as by cutting the ribbon from a larger sheet. The thin and long ribbon is then shaped to include the undulating shape, if desired. The thin and long ribbon may also be punched or drilled to form apertures in elongate strip, if desired. This is accomplished, for example, by passing the thin and long ribbon between a pair of corrugated rollers. The teeth of the roller bend the ribbon into an undulating shape. Different undulating shapes are possible in different embodiments by using rollers having appropriately shaped teeth. Example teeth shapes include sinusoidal teeth, triangular teeth, semi-circular teeth, square (or rectangular) teeth, saw-tooth shaped teeth, or other desired shapes. Elongate strips having no undulating pattern are used in some embodiments, in which case the thin and long ribbons typically do not require further shaping. The elongate strips and may alternatively be formed by other processes, such as by molding, a progressive die press where the ribbon is stamped over a particular distance, or by extrusion.

After the elongate strips are formed, support legs are formed and positioned between elongate strips with a die component. In one possible embodiment, a first elongate strip is passed through the first elongate strip guide and a second elongate strip is passed through a second elongate strip guide. The first guide and the second guide orient the elongate strips in a parallel and facing arrangement and space them a desired distance apart. An extrusion die is arranged near the guide and between elongate strips. As the elongate strips pass through the guide, a support leg material is extruded into a support leg mold between elongate strips. Extrusion typically involves heating the support leg material and using a hydraulic, or other, press to push the support leg material through the extrusion die. The guide also presses the extruded support legs against interior surfaces of elongate strips, such that the support legs conform to the undulating shape and are connected to elongate strips.

In one embodiment, after the elongate strips are joined, filler is inserted through an aperture, such as a slit, in one of the support legs. In one embodiment, the filler is not placed at the corner locations. An automated control component can be used to control the filler application equipment to accomplish this placement. In one embodiment, filler is inserted between the first and second elongate strips, and between the support legs during the process of forming the spacer.

After formation of the spacer, it can be cut to an appropriate length, such as sufficiently long to be positioned at the entire perimeter of the window assembly, or long enough for individual sides of the window assembly. Adhesive is deposited on a surface of the first elongate strip that is configured to receive the edge of an intermediary sheet. Adhesive or sealant is also placed in the pockets at the same time, in some embodiments. An edge of the intermediary sheet is brought into contact with the adhesive on the receiving surface of the first elongate strip, and the spacer is wrapped around the perimeter of the intermediary sheet. A first sheet and second sheet are coupled to the adhesive disposed along each respective side of the spacer. Further details regarding embodiments of the assembly process and applicator apparatus are described in U.S. patent application Ser. No. 13/157,866, "WINDOW SPACER APPLICATOR", filed Jun. 10, 2011.

An example of a system and method for forming a window assembly has been described, but those of skill in the art will be aware of many options and alternatives to the equipment and method steps described that can be used.

Various embodiments are described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

What is claimed is:

1. A spacer for a three pane insulated glass unit (IGU), the spacer comprising:

an inner metal elongate strip defining:

(i) a first undulating shape along its length;

(ii) a registration structure for receiving an intermediate pane of the IGU; and (iii) first and second co-planar portions on opposing sides of the registration structure, wherein the first and second co-planar portions define first and second sets of apertures, respectively;

an outer metal elongate strip defining a second undulating shape; and a filler disposed in an interior space between the inner and outer metal elongate strips, the filler including a desiccant and only occupying a portion of the interior space that is less than a volume of the interior space.

2. The spacer of claim 1, wherein (i) a first space defined by the intermediate pane and the first co-planar portion of the inner metal elongate strip is in direct fluid communication with (ii) a second space defined by the intermediate pane and the second co-planar portion of the inner metal elongate strip.

3. The spacer of claim 2, wherein the direct fluid communication is through a void located above a top surface of the filler and below the first and second sets of apertures.

4. The spacer of claim 1, further comprising:

one or more first non-metal support legs arranged between the first co-planar portion of the inner metal elongate strip and the outer metal elongate strip; and one or more second non-metal support legs arranged between the second co-planar portion of the inner metal elongate strip and the outer metal elongate strip.

5. The spacer of claim 1, wherein the registration structure is a recessed channel defined in the inner metal elongate strip.

6. The spacer of claim 5, wherein the recessed channel defines a width for accommodating the intermediate pane.

7. The spacer of claim 1, wherein the registration structure is an aperture in the inner metal elongate strip.

8. The spacer of claim 1, wherein the filler is a matrix desiccant configured to at least partially support the inner elongate strip.

9. The spacer of claim 1, wherein the filler is a matrix desiccant configured to at least partially support the intermediate pane.

10. An insulated glass unit (IGU), comprising:

a first pane;

a second pane;

an intermediate pane disposed between the first and second panes; and a spacer comprising:

an inner metal elongate strip defining:

(i) a first undulating shape along its length;

(ii) a registration structure for receiving the intermediate pane;

(iii) first and second co-planar portions on opposing sides of the registration structure, wherein the first and second co-planar portions define first and second sets of apertures, respectively;

an outer metal elongate strip defining a second undulating shape; and a filler disposed in an interior space defined by the inner and outer metal elongate strips and the first and second panes, the filler including a desiccant and only occupying a portion of the interior space that is less than a volume of the interior space.

11. The IGU of claim 10, wherein (i) a first space defined by the intermediate pane, the first pane, and the first co-planar portion of the inner metal elongate strip is in direct fluid communication with (ii) a second space defined by the intermediate pane, the second pane, and the second co-planar portion of the inner metal elongate strip.

12. The IGU of claim 11, wherein the direct fluid communication is through a void located above a top surface of the filler and below the first and second sets of apertures.

13. The IGU of claim 10, further comprising:

one or more first non-metal support legs arranged between the first co-planar portion of the inner metal elongate strip and the outer metal elongate strip; and one or more second non-metal support legs arranged between the second co-planar portion of the inner metal elongate strip and the outer metal elongate strip.

14. The IGU of claim 13, further comprising a sealant disposed in (i) a first cavity defined by the first co-planar portion of the inner metal elongate strip, the outer metal elongate strip, the first pane, and one of the one or more first non-metal support legs and (ii) a second cavity defined by the second co-planar portion of the inner metal elongate strip, the outer metal elongate strip, the second pane, and one of the one or more second non-metal support legs.

15. The IGU of claim 10, further comprising a sealant disposed between the registration structure and the intermediate pane.

16. The IGU of claim 10, wherein the registration structure is a recessed channel defined in the inner metal elongate strip.

17. The IGU of claim 16, wherein the recessed channel defines a width for accommodating the intermediate pane.

18. The IGU of claim 10, wherein the registration structure is an aperture in the inner metal elongate strip.

19. The IGU of claim 10, wherein the filler is a matrix desiccant configured to at least partially support the inner elongate strip.

20. The IGU of claim 10, wherein the filler is a matrix desiccant configured to at least partially support the intermediate pane.

* * * * *